United States Patent [19]

Skimming

[11] 3,963,166

[45] June 15, 1976

[54] PACKAGING MEANS FOR FRAGILE ARTICLES

[75] Inventor: William Sutton Baker Skimming, Worcester, England

[73] Assignee: The Worcester Royal Porcelain Co., Ltd., Worcester, England

[22] Filed: Dec. 30, 1974

[21] Appl. No.: 537,382

[30] Foreign Application Priority Data

Jan. 3, 1974 United Kingdom ..... 327/74

[52] U.S. Cl. ..... 229/14 C; 206/8; 206/452

[51] Int. Cl.[2] ..... B65D 5/16; B65D 5/50

[58] Field of Search ..... 229/14 C, 14 BL; 206/452, 8

[56] References Cited

UNITED STATES PATENTS

| | | | |
|---|---|---|---|
| 968,842 | 8/1910 | Foote | 206/8 |
| 1,851,510 | 3/1932 | Hart | 206/8 |
| 2,199,716 | 5/1940 | Shinberger | 206/8 |
| 2,343,128 | 2/1944 | Anderson | 206/8 X |
| 2,744,622 | 5/1956 | Sparks | 229/14 C X |
| 2,943,733 | 7/1960 | Poeschl et al. | 206/452 |
| 3,294,226 | 12/1966 | McFarland et al. | 229/14 C X |
| 3,506,112 | 4/1970 | Feinberg et al. | 206/8 |
| 3,587,836 | 6/1971 | Brown | 206/8 |
| 3,603,322 | 9/1971 | Wilson | 206/8 UX |
| 3,750,192 | 8/1973 | Beresic | 206/8 |

*Primary Examiner*—Davis T. Moorhead
*Attorney, Agent, or Firm*—Holman & Stern

[57] ABSTRACT

A packaging means intended to contain one or more fragile articles such as ceramic models comprises a container with walls of shock absorbing material, and supporting means in the container for holding a relatively robust part of the article in a position such that the article is held away from the walls of the container. The supporting means, which may take the form of a shelf with parts which can be moved in the plane of the shelf to hold or release the article, is held in the container with shock absorbing means which allows the supporting means to move relative to the container.

8 Claims, 5 Drawing Figures

8
9
26
27
31
27
26
25
40
11a
11a
18
11
12
20
21
19
24
16
15
14
18
17
10a
10
13
22
30
28
29
32
29
28
38
39

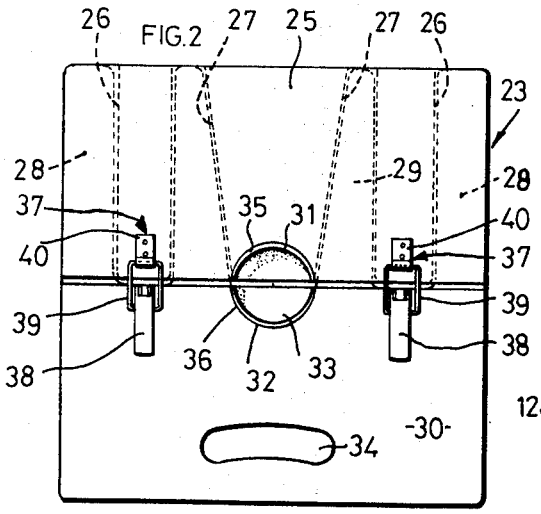
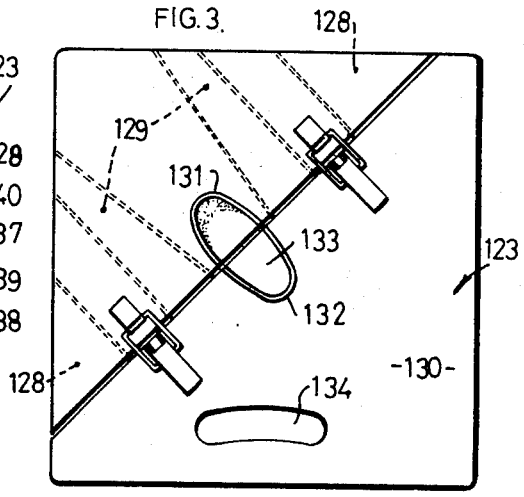
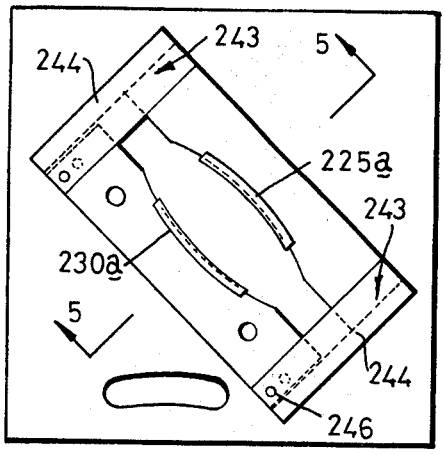
FIG.4.
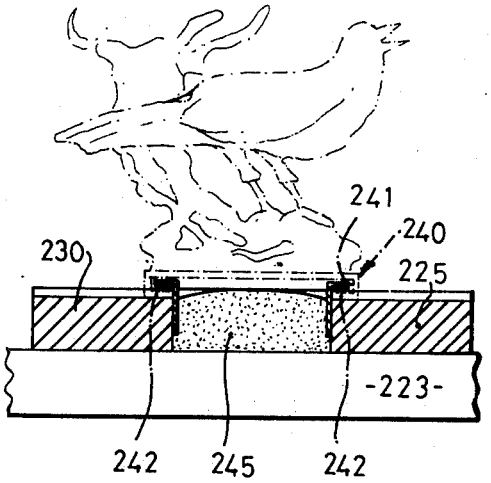
FIG.5.

PACKAGING MEANS FOR FRAGILE ARTICLES

BACKGROUND OF THE INVENTION

FIELD OF THE INVENTION

This invention relates to protective packaging means containing, or adapted to contain, one or more fragile articles.

The invention has been developed primarily in relation to the protective packaging of ceramic ware, particularly, but not exclusively, to models forming works of artistic merit. Frequently such models incorporate portions of extreme fragility. For example, when the models are floral in character the stamens of the flowers may be extremely slender since they often protrude for an appreciable distance from the petal formation of the flower, they are to a large extent, unprotected and are exposed to high risk of fracture. Further, because of their slender character they are supported from the rest of the model only by portions of small cross-sectional dimensions which are unable to withstand the forces generated through high acceleration, as, for example, when a package is dropped and falls on a hard surface.

It will be understood, however, that the invention is not limited to packaging means for such models but may be applied to other fragile articles in cases where similar or analogous problems arise.

SUMMARY OF THE INVENTION

The main object of the present invention is to provide a new or improved form of packaging means which will provide better protection to the fragile article or articles than those heretofore in use.

According to the present invention we provide a packaging means containing, or adapted to contain, one or more fragile articles and comprising a container having walls made of a shock absorbing material, supporting means in the interior of the container positionally controlling the article or each article to maintain such article in spaced relation from the walls of the container, such supporting means incorporating holding parts movable relatively to each other between a holding position in which such parts are in engagement with a base, plinth or other relatively robust portion of the article concerned to hold the article in the position aforesaid, and a releasing position in which the article is freely removable from the supporting means, and shock absorbing means acting between the supporting means and the container allowing the supporting means to undergo limited movement relatively to the container should the latter be subjected to external shock.

In a preferred construction in accordance with the invention the supporting means may be in the form of a shelf, platform, or other member of like form and the container may have an opening through which the shelf or the like member can be moved into and out of the container, the latter having guideways for engaging opposite margins of the shelf or like member to positionally control the latter in a direction normal to its own plane.

Preferably the shock absorbing means is interposed between the margins of the shelf or like member and the guideways so that the shelf is permitted to undergo limited displacement in a direction normal to its own plane. The ends of the guideways both adjacent to the opening and remote therefrom may also incorporate a portion of the shock absorbing means, thereby providing for limited movement of the shelf or like member parallel to its own plane as well as normal thereto. With this arrangement whatever may be the direction in which a shock load is applied externally to the container, there is limited freedom of movement of the shelf or like member to undergo displacement under the control of the shock absorbing means so that the shock forces which might produce fracture of the article supported by the shelf or like member are reduced.

The holding parts incorporated in the supporting means may be movable relatively to each other between the holding and releasing positions planarly. In cases where the supporting means comprises a shelf or like member as aforesaid, the holding parts may be incorporated in, or mounted on, the shelf or like member to move relatively to each other in a direction parallel to the plane of the shelf or like member itself.

Collectively the holding parts, when in their holding positions, may wholly or in part define the lateral boundaries of a recess in which the base, plinth or other relatively robust part of the article may be seated, the holding parts engaging faces of said base, plinth or relatively robust part in such a manner as to retain this frictionally in the recess or by virtue of complementary interfitting formations on said base, plinth or other relatively robust part and on said holding parts respectively positively preventing withdrawal from the recess.

In association with the container may be provided a further or outer container having spacing means, preferably of shock absorbing material, maintaining a spaced relation between each wall of the further container and the corresponding opposed wall of the first said or inner container. The walls of the further or outer container may themselves be of hollow form, i.e., formed of spaced parallel plates or sheets of a suitable material.

BRIEF DESCRIPTION OF DRAWINGS

The invention will now be described, by way of example, with reference to the accompanying drawings wherein:

FIG. 2 is a view in plan of the supporting means of the container of FIG. 1;

FIG. 3 is a plan view of a second embodiment of supporting means which may be utilized with the container of FIG. 1;

FIG. 4 is a plan view of a further embodiment of supporting means which may be used in conjunction with the container of FIG. 1;

FIG. 5 is a fragmentary view of the supporting means of FIG. 4 in cross-section on the line B—B thereof.

DESCRIPTION OF PREFERRED EMBODIMENT

Figure 1:
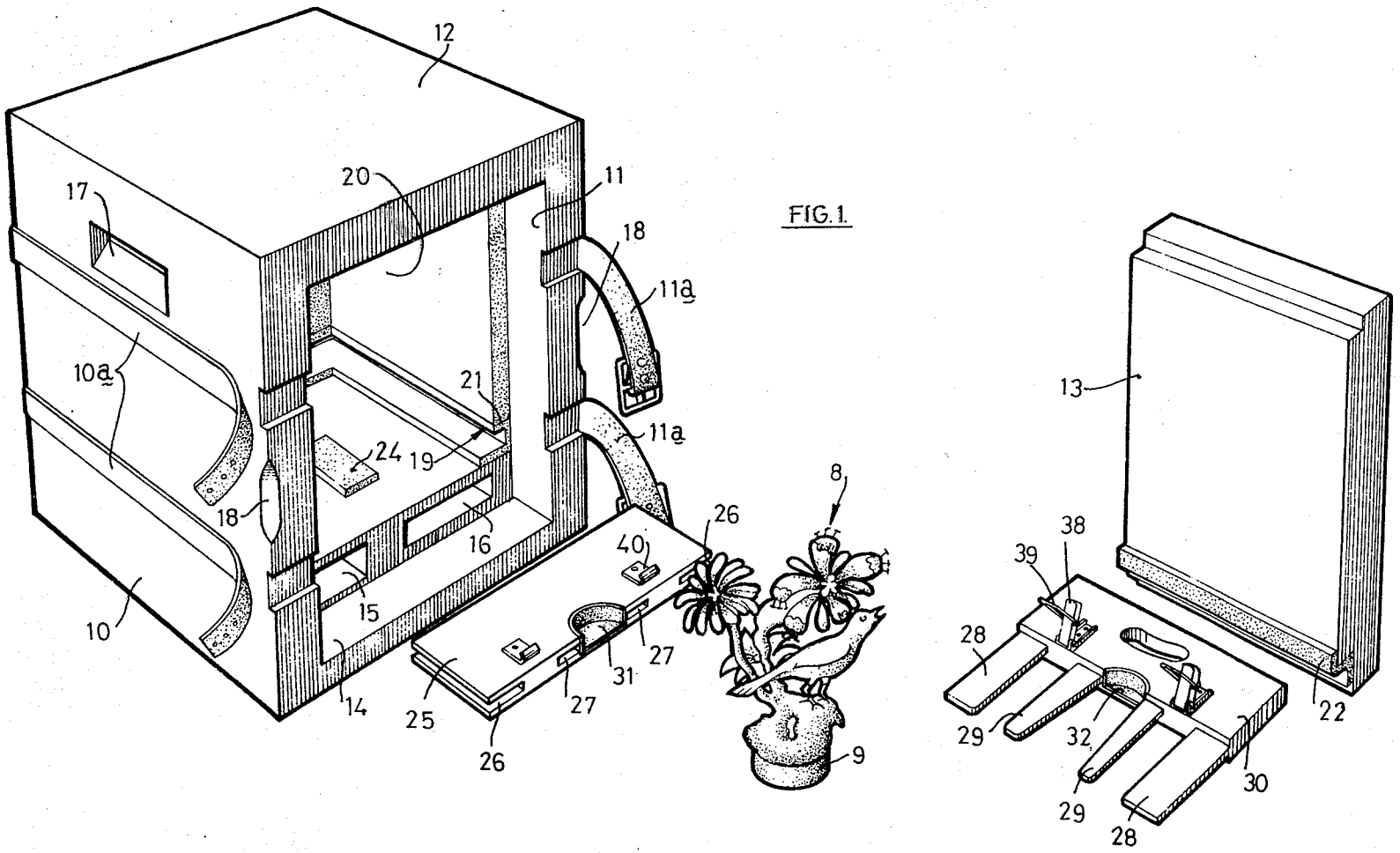
FIG. 1 is an exploded perspective of the main or inner container of one embodiment of packaging means in accordance with the invention, with a packaged article.

Referring firstly to FIG. 1, the main or inner container shown therein is conveniently but not essentially of rectangular form, as viewed in front elevation, side elevation and plan, and incorporates side walls 10, 11, a top wall 12, a front wall 13 in the form of a removable cover, and a bottom wall 14.

Each of these walls may be formed of a plate-like member of suitable shock absorbing material, for example expanded polystyrene, and all of these walls except the bottom wall may have a thickness in the range 2 to 3 inches although this can be varied as required to provide a greater or lesser degree of protection according to the fragility of the article which the package as a whole is intended to enclose and protect.

The embodiment now described is intended to be utilised to contain and protect a ceramic article of substantial value, such an article being shown at 8, for example a model of artistic merit of which only a single one exists or of which only a limited number have been produced.

In certain cases such articles include a structurally separate plinth shaped to interfit with a base portion 9 of the article, such base portion being relatively robust compared with other parts of the article connected thereto and extending upwardly from the base portion.

Accordingly the bottom wall 14 incorporates cavities 15 and 16 both opening into the front face of the bottom wall and of which the former may be utilized for the accommodation of the removable plinth, and the latter for documentation relating to the article in question, for example a certificate bearing the number of the particular model if limited production only thereof has been undertaken.

The walls of the container may be secured permanently to each other in any suitable manner, for example by means of a suitable cement, although it would be within the scope of the invention for these walls, other than the removable cover 13, to be formed integrally with each other.

To enable the container readily to be lifted, the side walls 10 incorporate recesses 17 in their external faces of a form to provide hand holds, that is the upper boundaries of these recesses are formed of faces which are either at right angles to the outer surface of the side wall or are undercut slightly relatively thereto if desired. At a lower position such walls may incorporate further recesses, as seen at 18, to enable the person handling the container, for example, lifting it above his head, to insert one or more fingers into the recesses 18 and thereby avoid reliance upon frictional grip with the palm of the hand.

The side walls 10, 11 are provided with straps 10*a*, 11*a* for holding the front wall in position.

Internally, the container is provided with guideways each in the form of a channel 19 having its open mouth presented laterally inwardly and extending fore and aft across the lower region of a respective one of the side walls 10 so that there are a pair of channels facing each other with their ends presented at the lower end of the opening 20 which is afforded at the interior of the container when the cover 13 is in its open or removed position.

Each of these channels is lined with a shock absorbing means, for example a layer 21 of foamed or cellular plastics material or foamed rubber. The shock absorbing lining lies against both the top and bottom walls of the channel and the base or lateral wall of the channel, and includes a portion at the inner end of each channel. A further portion 22 is provided at the outer end of each channel and conveniently is secured to the cover member. Thus when the cover is in its closed position all of the exposed surfaces of the channels are covered with a layer of shock absorbing material.

The article concerned, for example the model previously referred to, is held in a predetermined position in the interior of the main or inner container such that all parts of the model are spaced from the walls of the container. With respect to the side, rear and top walls, this spacing may be approximately equal but may be rather less in relation to the bottom wall 14, partly because the latter is of greater thickness and therefore has greater shock absorbing properties, and partly because the supporting means for the model is interposed between the model and the bottom wall and, therefore, acts as a further protective means.

Whilst various forms of supporting means may be employed in combination with the container shown in FIG. 1 provided that such supporting means incorporates holding parts for gripping or interfitting with the model or other article, three different embodiments of supporting means are illustrated by way of example in FIGS. 2 to 5 to which reference will now be made.

The supporting means illustrated in FIGS. 1 and 2 comprises a shelf, platform or the like plate-like member indicated generally at 23, the lateral margins of which engage slidably in the channels 19 already referred to and are separated from the boundaries of these channels when the shelf is inserted by the shock absorbing material 21, 22.

Further, a piece 24 of shock absorbing material may be provided centrally on the interior face of the bottom wall 14 to engage the undersurface of the shelf in its central region immediately beneath the position at which the model is supported therefrom.

The shelf may incorporate two holding parts which are movable relatively to each other, one of these parts being indicated at 25 and incorporating a plurality of passageways 26, 27 for reception of projecting tongues 28, 29 on the other part 30. These passageways 26 and their associated tongues 28 engaging therein are of parallel-sided form as viewed in plan, whereas the passageways 27 and associated tongues 29 may be of tapering form as viewed in plan. The interfitting tongues and passageways constrain the holding parts 25 and 30 to planar movement in a plane parallel to that of the shelf itself. The opposed inner edges of the holding parts 25, 30 are shaped in their central regions as indicated at 31, 32, collectively to define the boundaries of a recess 33 in which the base portion of the model or other article may be received.

An aperture 34 forming a hand hold allows the part 25 and 30 to be moved slidably to a releasing position in which the base portion of the model or article can be inserted easily into the recess 33, and the parts are then moved slidably towards each other into a holding position to grip the lateral boundaries of the base portion.

To ensure that the base portion is securely gripped the faces of the holding parts which form the boundaries of the recesses are preferably lined with sheet material, as indicated at 35, 36. The sheet material may be of rubber or plastics material, preferably having some shock absorbing characteristics as well as a high coefficient of friction with respect to the material of which the model or other article is made.

For retaining the holding parts 24, 30 in the holding position, retaining means are provided preferably of a form to act positively in retaining the parts in the holding position. Thus one advantageous form of retaining means which may be provided as seen in FIG. 2 comprises clasps 37 each incorporating a lever 38 and a pivotal frame 39 secured to one of the parts, for example 30, and incorporating a catch member 40 secured to the upper holding part 25, the frame 39 engaging with the catch member 40 and constituting, in conbination with the lever 38, a toggle mechanism which draws the holding parts 25 to 30 together as the lever 38 is depressed towards the upper surface of the holding part 30. When the lever 38 is moved pivotally away from the upper surface of the holding part 30 and towards the holding part 25, the toggle mechanism frame 39 will move upwardly as seen in FIG. 2 but may still remain engaged with the catch member 40 thereby providing for retention of the holding parts 25 and 30 in assembled relation but expanding the dimension of the recess 33 sufficiently to allow the base portion of the article to be inserted.

The shelf or platform 23 may be formed of any suitable material. For example, the holding parts 25 and 30 incorporated therein may be made from wood.

In FIG. 3 is illustrated a modified form of supporting means in which parts corresponding to those already described are designated by like references with the prefix 1 and to which the preceding description is to be deemed to apply.

In this case the parting line or surface between the holding parts 125, 130 extends somewhat diagonally of the shelf or platform which collectively is formed by these parts instead of parallel to one side thereof. The shape of the cut-out or recessed portions 131 and 132 is also shown as differing to suit a differing configuration of base portion.

It will be understood that in either of these embodiments more than one recess 33 or 133 may be provided by forming an appropriate number of cut-outs in the holding parts as required.

In the embodiment of supporting means illustrated in FIGS. 4 and 5, the holding means again comprises a shelf or platform 223 of rectangular form and opposite lateral margins of which would be inserted into the channels 19 of the main or inner container.

This supporting means is designed to support a model or article of which the base portion 240 has a recess 241 formed at its underside and bounded by inturned lips 242.

The holding parts 225, 230 comprise elongate blocks one of which is fixed on the shelf or platform 223 and the other of which is slidable in a plane parallel to the shelf or platform 223 in guide channels 243 formed between the shelf and L-section members 244 secured thereto. Between the two holding parts 225, 230 is interposed spring means, for example a pad of foamed rubber or plastics material having some elasticity, as indicated at 245, which tends to move the holding parts away from each other. The holding parts carry strip-like members **225*a*, 230*a* respectively each having an out-turned flange at its upper end to engage above the lip 242 of the base of the model of article. Thus initially the holding parts 225, 230 are moved towards each other by finger pressure to introduce the strips 225*a*, 230*a* into the recess 241 and the holding parts are then allowed to move apart under the influence of the resilience pad 245 to provide positive interlocking between the lip 242 and the flanges of the strips 225*a*, 230*a*. The holding parts may be secured in this position by removable pins inserted through openings 246 in the movable holding part 230 and engaging in underlying openings in the shelf or platform 223**.

It will of course be understood that in addition to providing more than one recess in a shelf, platform or the like member where the latter may be able satisfactorily to support a number of articles or models (where these are of appropriately small size), a single container may be equipped with more than one supporting means such as the shelves or platforms illustrated and described. Such shelves or platforms would be superposed in vertically spaced relation, each engaging in a pair of channels such as 19 equipped with shock absorbent material such as 21.

I claim:

1. Packaging means for containing at least one fragile article, such packaging means comprising:

a. a container having walls of a shock absorbing material, b. supporting means in the interior of the container for positionally controlling the article to maintain such article in spaced relation from the walls of the container, such supporting means incorporating holding parts movable relatively to each other between a holding position in which such parts engage with a relatively robust part of the article concerned to hold the article in position, and a releasing position in which the article is freely removable from the supporting means, c. means separate from the holding parts for retaining the holding parts in the holding position, and d. shock absorbing means acting between the supporting means and the container for allowing the supporting means to undergo limited movement relatively to the container.

2. Packaging means as claimed in claim 1 wherein:

a. the supporting means comprises a shelf member, b. the container has an opening through which the shelf member can be moved into and out of the container, c. the container has means defining guide-ways for engaging opposite margins of the shelf member, and d. the shock absorbing means is interposed between the margins of the shelf member and the guide-ways for allowing the shelf member to undergo limited displacement in a direction normal to its own plane said shock absorbing means comprising a material selected from the group consisting of foamed or cellular plastics material and foamed rubber.

3. Packaging means as claimed in claim 2 wherein the ends of the guideways both adjacent to the opening and remote therefrom also incorporate a portion of the shock absorbing means for providing for limited movement of the shelf member parallel to its own plane.

4. Packaging means as claimed in claim 2 wherein:

a. the shelf member incorporates the holding parts, b. the holding parts at least partly define the lateral boundaries of a recess for receiving the relatively robust part of the article, c. the holding parts are movable planarly between the holding and releasing positions.

5. In combination, a fragile article having a fragile portion and a relatively robust base portion, and packaging means therefor, the packaging means comprising:

a. a container having walls of a shock absorbing material, b. supporting means in the interior of the container for maintaining the article in spaced relation from the walls of the container, the supporting means incorporating holding parts engaging the base portion of the article for holding the article in position, c. means for retaining the holding parts in the holding position, and d. shock absorbing means acting between the supporting means and the container for allowing the supporting means to undergo limited movement relatively to the container.

6. The combination according to claim 5 wherein:

a. the supporting means comprises a shelf member, b. the container has an opening through which the shelf member can be moved into and out of the container and has guide-ways for engaging opposite margins of the shelf member, and c. the shock absorbing means is interposed between the margins of the shelf member and the guide-ways for permitting the shelf member to undergo limited displacement in a direction normal to its own plane the shock absorbing means comprising a material selected from the group consisting of foamed or cellular plastics material and foamed rubber.

7. The combination as claimed in claim 5 wherein the holding parts at least partly define the lateral boundaries of a recess in which the relatively robust part of the article is received, the holding parts engaging faces of said relatively robust part to retain this frictionally in the recess.

8. The combination according to claim 5 wherein:

a. the relatively robust part of the article includes an undercut formation, b. the holding parts include complementary interfitting formations engaged with said undercut formation.

* * * * *